US005083669A

United States Patent [19]

Wisehart

[11] Patent Number: 5,083,669

[45] Date of Patent: Jan. 28, 1992

[54] FREE-STANDING TOOL RACK

[76] Inventor: Daniel J. Wisehart, 24211 Royalwick Ct., Tomball, Tex. 77375

[21] Appl. No.: 615,586

[22] Filed: Nov. 19, 1990

[51] Int. Cl.[5] ..... A47B 47/00

[52] U.S. Cl. ..... 211/70.6; 211/186; 211/189

[58] Field of Search ..... 211/69, 70.6, 133, 186, 211/189, 181, 182; 312/DIG. 33

[56] References Cited

U.S. PATENT DOCUMENTS 1,965,032 7/1934 Davey ..... 211/69
2,835,503 5/1958 Humphries et al. ..... 211/70.6 X
3,280,989 10/1966 Melvin et al. ..... 211/133
3,759,538 9/1973 Fabiano ..... 211/70.6 X
4,531,645 7/1985 Tisbo et al. ..... 211/70.6 X

*Primary Examiner*—Carl D. Friedman
*Assistant Examiner*—Derek J. Berger
*Attorney, Agent, or Firm*—Mary J. Gaskin

[57] ABSTRACT

A rack for organizing and storing tools that may be readily assembled from a knocked-down condition using conventional fasteners and tools is disclosed. The rack includes a top unit made of molded plastic with numerous slots and recessed compartments. A shelf at the base provides stability and storage space for large items. A pegboard mounted on the front can be used for hanging numerous items.

2 Claims, 3 Drawing Sheets

FREE-STANDING TOOL RACK

FIELD OF INVENTION

This invention, called "Rack-A-Tool", relates to a free-standing rack for organizing and storing a plurality of articles therein, such as tools, brooms, and sporting goods.

DESCRIPTION OF THE PRIOR ART

At the present time, household members frequently use their garages to store tools, brooms, sporting goods, and other implements. Sometimes larger items are stored on racks affixed to garage walls. Sometimes pegboards, likewise mounted on garage walls, are used to hang smaller items. Otherwise, shelving units and work surfaces become the repositories for items of every description. The result is garage clutter.

At present, no compact, free-standing unit is in use for organizing the plurality of typical "garage" items efficiently and conveniently.

SUMMARY OF THE INVENTION

The present invention provides a tool center suitable for organizing and storing household and garage-related items. The invention is free-standing It has maximum storage capabilities without altering supports or side walls.

A portion of the top of the invention is designed to hold up to a dozen long-handled objects, such as shovels, rakes, and brooms. Each item is positioned to stand vertically, with its handle inserted into one of two slots located on each side of the top of the rack. Stability for the handles is provided by receiving channel slots in the horizontal shelf at the base of the rack.

Adjacent to these slots are columns of slots of various sizes and shapes fashioned to provide storage for smaller, short-handled tools such as screwdrivers, pliers, wrenches, etc.

A recessed pencil tray is centered at the rear of the top of the rack. In front of the pencil tray is a row of small recessed sections for storing small items such as screws, nuts, bolts, pins, etc. In front of these sections are larger recessed sections for storing tubes of glue, caulking, etc.

The front, central portion of the top of the rack is a recessed storage compartment designed to store items such as tape, scissors, etc. It has a colored, hinged lid to protect items stored therein from dirt and dust. A drill bit holder designed to hold a set of thirteen (13) standard drill bits is molded into the underside of the lid.

A pegboard mounted vertically across the front of the rack is used for hanging a variety of short-handled tools, such as hammers, paintbrushes, wire cutters, clippers, etc.

On the left top side of the rack is an extended hook, designed to hold heavy-duty extension cords, rope, or chains.

On the right side of the top of the unit is located a hang-up plug, designed to hold an item such as a large hand saw.

A horizontal shelf is attached to the bottom of the four legs of the invention. It is used to store heavy tools such as power saws and drills, or bulk items such as bulk containers. The shelf has channel slots on either side for the ends of the handles of long handled items stored on the rack.

The invention's frame is constructed of plastic material, reinforced for strength and weight, or of metal. The top of the rack is constructed of molded plastic. The pegboard is constructed of wood, plastic, metal, or wood by-products. The bottom shelf is constructed of plastic, metal, wood, or wood by-products. The lower portion of the legs of the invention have been designed to stabilize the unit; the front legs angle forward to prevent the unit from falling forward or from becoming unbalanced.

Rack-A-Tool utilizes slightly more than three square feet of floor space.

The invention is manufactured at a low cost and is sold in a knocked-down condition. It is easily assembled by the consumer.

DESCRIPTION OF THE PREFERRED EMBODIMENT

Figure 1:
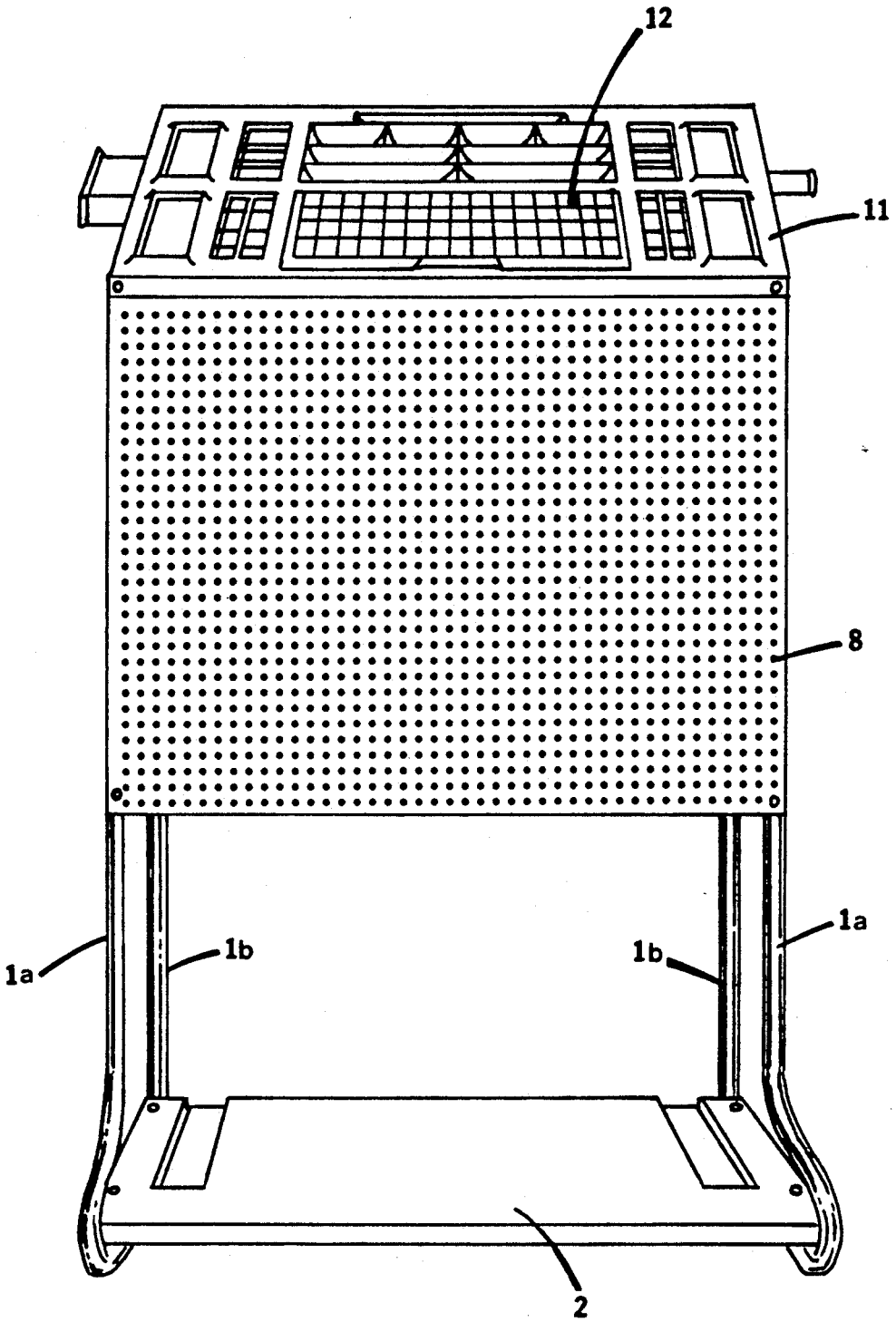
FIG. 1 is a front perspective view of the invention in an assembled position.

As shown in FIG. 1, the invention includes two (2) support members, 1*a* and 1*b*, each of which provides two (2) "legs." The top of the invention 11 contains slots and compartments, including a lidded compartment 12, for organizing and storing tools, etc. Attached vertically to the front upper portion of the invention and occupying over fifty percent (50%) of the frontal area is a pegboard 8. At the base of the invention is a horizontal shelf 2.

Figure 2:
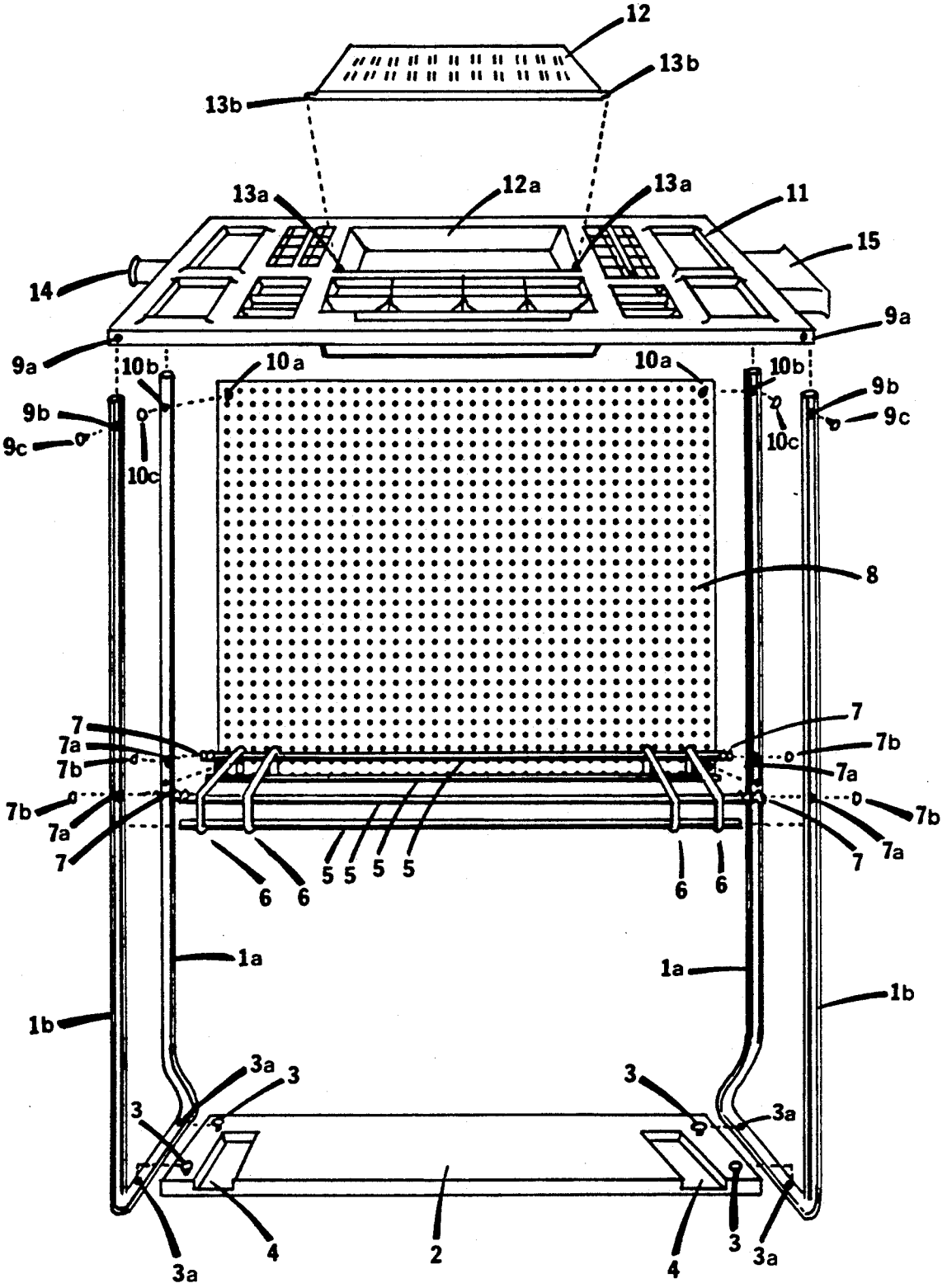
FIG. 2 is an exploded perspective view of the rear of the invention.

FIG. 2 shows the invention as it is to be assembled by the consumer. The rack has a frame structure composed of two (2) preformed hollow tubular members: a portion of each member 1*b* is vertical; another portion of each member 1*a* is parallel to member 1*b*, but extends forward as it approaches the floor, then is formed to rest against the floor, before joining the portion 1*b*. The overall effect is to provide stability to the assembled structure.

The two tubular members are spaced-apart, side frame parts which between them define a substantially rectangular, centrally open, horizontal area.

A rectangular shelf 2 is mounted horizontally between the two (2) tubular members 1*a* and 1*b* as follows: at each corner of the shelf is a through-extending hole which coincides with a through extending hole in the base portion of the tubular member 3*a;* at each corner, a machine screw 3 is turned through both through-extending holes to secure the shelf to the tubular members 1*a* and 1*b*.

The rectangular shelf 2 has two (2) channel slots 4 cut into its top surface, spaced close to either end of the shelf 2, and extending across most of the width of the shelf 2.

At approximately the midpoint of the tubular members 1*a* and 1*b*, an inner guide is situated. The inner guide consists of four (4) horizontal support members 5 spaced apart to define a substantially rectangular area at the midpoint of the tubular members 1*a* and 1*b*. The end 7 of each support member 5 is inserted through extending hole 7*a* in either tubular member 1*a* or 1*b* and fastened in position with a hex nut 7*b*.

The inner guide also has four (4) rail members 6, each shaped like a downwardly extending L, arranged perpendicular to the support members 5, two (2) on each end of the support members 5, each two (2) rail members 6 defining a rectangular slot through which the handles of long-handled tools will pass.

The top of the invention 11 is a preformed, rectangular unit which rests horizontally on the top of the tubular members 1*a* and 1*b*. Each back corner of 11 has a through extending hole 9*a* on its vertical surface which coincides with a through extending hole 9*b* in the tubular members 1*b*. A bolt 9*c* is passed through the through extending holes 9*a* and 9*b* and secured with a hex nut. Each front corner of 11 has a through extending hole on its vertical surface which coincides with a through extending hole 10*b* in the tubular member 1*a* which also coincides with a through extending hole 10*a* in the corner of the horizontal pegboard 8. A bolt is passed through the through extending holes 10*a*, through the through extending hole in the front corner of 11, and through the through extending hole 10*b* and secured with a hex nut 10*c*.

The top unit of the invention 11 has on one of its short sides a centrally-located projection 15 extending out from the rectangular shape and serving as a support for rope, chains, etc. On the opposite side of the invention a narrower cylindrical projection 14 extends out from the rectangular shape and serves as a support for an item such as a saw. At the center front of the top of the unit 11 is a recessed rectangular compartment with a rectangular lid 12 which is held in place by snapping outwardly extending projections 13*b* at the back corners of the lid 12 into associated indentations 13*a* at the top of the back corners of the recessed compartment 12*a*.

Figure 3:
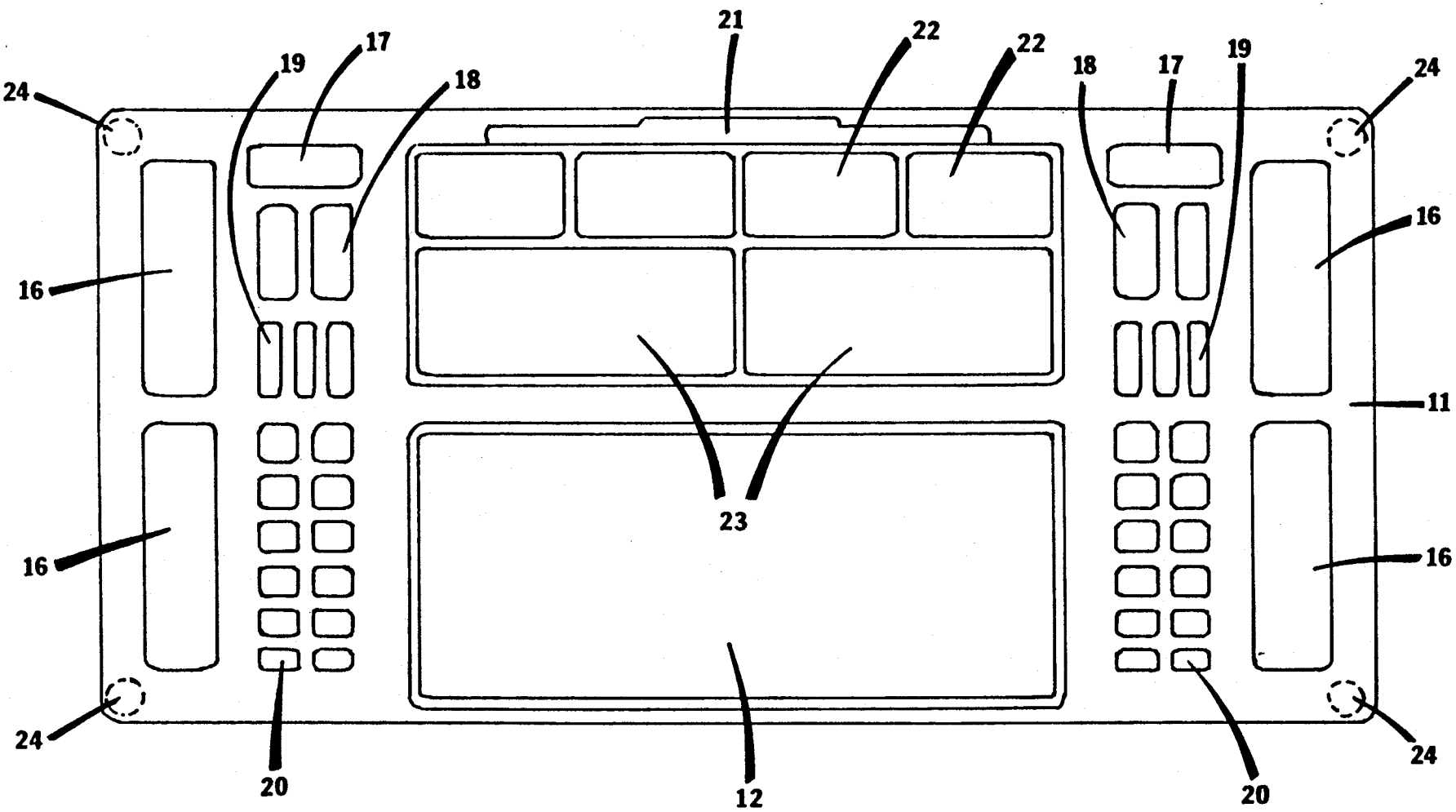
FIG. 3 is a top view of the invention.

FIG. 3 shows a typical arrangement of slots and compartments for the rectangular top unit 11 of the invention. Constructed of molded plastic, the top unit has four (4) slots cut through the top, arranged two (2) along each of the short sides of the rectangular top unit 11. Next to each set of slots 16, at the back of the top unit 11, is a slot 17 perpendicular to slots 16. In front of each slot 17 are three (3) slots 18, arranged parallel to slot 16. In front of each slot 18 is a shorter slot 19. In front of slots 19, arranged in two (2) rows parallel to slots 16, are approximately a dozen circular holes 20. At the midsection of the rear-facing long end of the top unit 11, is a recessed narrow indentation 21, with a length somewhat longer than that of a pencil. In front of the indentation 21 are a row of four (4) rectangular recessed compartments 22. In front of compartments 22 are two (2) larger rectangular compartments 23. In front of compartments 23 is the large lidded, rectangular, recessed compartment 12. FIG. 3 shows the tops of the tubular members 1*a* and 1*b* at positions 24, as they are situated underneath the top unit 11.

There has been disclosed heretofore the best embodiment of the invention presently contemplated. However, it is to be understood that various changes and modifications may be made thereto without departing from the spirit of the invention.

I claim:

1. Apparatus for the support and storage of a plurality of objects on a supporting structure, said apparatus comprising:

(a) four (4) parallel posts, in two (2) pairs, each pair connected at the lower end to form a flat base the overall configuration approximating a "U" shape, said pairs vertically spaced apart to approximate a rectangular shape;

(b) a horizontal shelf disposed between the pairs of posts at the lower ends of said posts;

(c) securing means connecting the shelf to the lower ends of the pairs of posts;

(d) a rectangular inner guide horizontally disposed at the approximate midpoints of the four (4) posts and connected thereto by securing means;

(e) a horizontally-disposed, rectangular, molded plastic unit connected to the tops of the four (4) posts at each corner by securing means, said molded plastic unit having a plurality of slots and recessed compartments;

(f) said apparatus being readily disposed in a knocked-down condition for shipping thereof.

2. Apparatus according to claim 1, wherein there is further included a rectangular panel having a plurality of mounting apertures for receiving hooks for holding articles on the panel, said panel vertically disposed at the top front portion of the apparatus between the anterior two of said four posts and connected thereto by securing means.

* * * * *